US011027287B2

(12) United States Patent
Jacobson

(10) Patent No.: US 11,027,287 B2
(45) Date of Patent: Jun. 8, 2021

(54) GYRATORY CRUSHER INCLUDING A VARIABLE SPEED DRIVE AND CONTROL SYSTEM

(71) Applicant: Metso Minerals Industries, Inc., Waukesha, WI (US)

(72) Inventor: Dustin Jacobson, Fort Atkinson, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 192 days.

(21) Appl. No.: 16/048,883

(22) Filed: Jul. 30, 2018

(65) Prior Publication Data

US 2020/0030812 A1 Jan. 30, 2020

(51) Int. Cl.

| | |
|---|---|
| ***B02C 25/00*** | (2006.01) |
| ***B02C 23/02*** | (2006.01) |
| ***B02C 2/04*** | (2006.01) |
| ***B02C 2/08*** | (2006.01) |

(52) U.S. Cl.

CPC ..... *B02C 25/00* (2013.01); *B02C 2/04* (2013.01); *B02C 2/08* (2013.01); *B02C 23/02* (2013.01)

(58) Field of Classification Search

CPC .. B02C 25/00; B02C 2/04; B02C 2/02; B02C 2/047

USPC ..... 241/33–37, 207–216

See application file for complete search history.

(56) References Cited

U.S. PATENT DOCUMENTS

| | | | | |
|---|---|---|---|---|
| 4,793,560 | A | 12/1988 | Schrodl | |
| 5,718,391 | A | 2/1998 | Musil | |
| 7,322,536 | B2 | 1/2008 | Garvin et al. | |
| 7,478,771 | B2 | 1/2009 | Whittaker | |
| 7,850,103 | B2 * | 12/2010 | Eriksson | B02C 2/047 241/207 |
| 8,109,454 | B2 | 2/2012 | Lehtonen et al. | |
| 8,540,176 | B2 | 9/2013 | Wallin et al. | |
| 8,770,501 | B2 | 7/2014 | Laukka et al. | |
| 8,899,502 | B2 | 12/2014 | Lehtonen et al. | |
| 9,004,385 | B2 * | 4/2015 | Leshem | B02C 18/04 241/283 |
| 9,084,998 | B2 | 7/2015 | Belotserkovskiy | |
| 9,205,431 | B2 * | 12/2015 | Anderson, Jr. | B02C 25/00 |

(Continued)

OTHER PUBLICATIONS

International Search Report and Written Opinion for International Application No. PCT/US2019/043875 dated Oct. 4, 2019.

*Primary Examiner* — Faye Francis

(74) *Attorney, Agent, or Firm* — Andrus Intellectual Property Law, LLP

(57) ABSTRACT

A system and method for controlling the operation of a gyratory rock crusher is shown and described. The gyratory rock crusher includes a variable frequency drive that allows the eccentric speed of the gyratory crusher to be modified based upon sensed parameters of the rock crushing system. The speed of the eccentric rotation can be dynamically adjusted to compensate for the size of the material particles being crushed and the availability of the material. The use of the variable frequency drive increases the operating efficiency of the gyratory crusher by controlling the discharge flow rate of the crushed material from the crusher and thus allows for a reduction in the size of the discharge hopper. The rotational speed of the eccentric is controlled to be below the critical speed for the gyratory crusher.

7 Claims, 3 Drawing Sheets

(56) References Cited

U.S. PATENT DOCUMENTS

| | | | | |
|---|---|---|---|---|
| 9,700,898 | B1 | 7/2017 | Shumka et al. | |
| 2009/0294559 | A1* | 12/2009 | Eriksson | B02C 25/00 241/30 |
| 2013/0134243 | A1* | 5/2013 | Leshem | B02C 18/04 241/33 |
| 2014/0263777 | A1* | 9/2014 | Anderson, Jr. | B02C 25/00 241/30 |
| 2015/0076259 | A1 | 3/2015 | Salonen | |

* cited by examiner

GYRATORY CRUSHER INCLUDING A VARIABLE SPEED DRIVE AND CONTROL SYSTEM

BACKGROUND

The present disclosure generally relates to a rock crushing machine, such as a rock crusher of configurations commonly referred to as a gyratory crusher. More specifically, the present disclosure relates to a gyratory crusher that includes a variable speed drive and control system for controlling the operation of the gyratory crusher to optimize the discharge flow rate from the gyratory crusher.

Rock crushing machines break apart rock, stone or other materials in a crushing cavity formed between a downwardly expanding conical mantle installed on a mainshaft that gyrates within an outer upwardly expanding frustoconically shaped assembly of concaves inside a crusher outer shell. The conical mantle and the mainshaft are circularly symmetric about an axis that is inclined with respect to the vertical outer shell assembly axis. These axes intersect near the top of the rock crusher. The inclined axis is driven circularly about the vertical axis thereby imparting a gyrational motion to the mainshaft and mantle. The gyrational motion causes points on the mantle surface to alternately advance toward and retreat away from stationary concaves mounted to the outer shell. During retreat of the mantle, material to be crushed falls deeper into the cavity where it is crushed when motion reverses and the mantle advances toward the concaves on the outer shell.

Gyratory crushers typically include a discharge hopper that is located at the discharge end of the gyratory crusher to accumulate the material after the material has passed through the gyratory crusher. The size of the discharge hopper must be sufficient to accumulate the material after passing through the gyratory crusher before the material is discharged by a feeder onto a conveyor assembly. Since the operational speed of the feeder and conveyor assembly is typically constant while the feed of material into the gyratory crusher is generally uncontrolled, the discharge hopper must be large enough to accumulate material during high flow rates from the gyratory crusher. In some embodiments, the discharge hopper has a height of 6-8 meters.

The size of the discharge hopper is a significant variable in the cost of creating a rock crushing system that includes the gyratory crusher. The present inventor has identified a desire to reduce the size of the discharge hopper by optimizing the operation of the gyratory crusher, resulting in a smaller rock crushing system and reducing the cost associated with the discharge hopper and the energy consumption of the rock crushing system To increase the efficiency of the crushing process, the operation of the gyratory crusher can be adjusted. In typical gyratory crushers, the operation of the crusher can be adjusted by controlling the size of the crushing gap by moving a mainshaft vertically with respect to the frame of the crusher. This adjustment modifies the size of the discharge particles from the gyratory crusher. Another adjustment possible in a gyratory crusher is to modify the gyratory speed of the mantle. In currently available gyratory crushers, adjusting the gyratory speed is limited based upon the drive motor used to create the gyrational movement. The inventor has recognized that an improvement in the drive of the gyratory crusher will increase operational efficiency.

SUMMARY

The present disclosure relates to a gyratory crusher that includes a variable drive and control system for controlling the operation of the gyratory crusher to optimize the discharge flow rate from the gyratory crusher.

The gyratory crusher of an exemplary embodiment of the present disclosure operates to reduce the size of material that is fed into an open feed end of the gyratory crusher. The gyratory crusher includes a stationary outer shell and a mainshaft that has a mantle. The mainshaft includes an eccentric that is positioned around a portion of the mainshaft such that the eccentric creates rotation of the mainshaft within the gyratory crusher. Material is trapped between an inner surface of the outer shell and an outer surface of the mantle within a crushing gap. Rotation of the mainshaft within the outer shell crushes material as the material enters into the crushing gap.

The gyratory crusher further includes a variable frequency drive that is directly or indirectly coupled to the eccentric to create rotation of the eccentric and the mainshaft. In one exemplary embodiment, the variable frequency drive includes an electric motor and a variable frequency controller. The variable frequency controller outputs a control signal to the electric motor which adjusts the rotational speed of the electric motor. In this manner, the variable frequency drive can dynamically adjust the rotational speed of the mainshaft within the stationary outer shell.

The gyratory crusher further includes a control system that can operate to control the rotational speed of the eccentric through control of the variable frequency drive. In one embodiment of the disclosure, a camera is positioned to detect the particle size of the material fed into the dump hopper. Another sensor can be used to detect the amount of material contained within the dump hopper. The control system can dynamically adjust the rotational speed of the eccentric through the variable frequency drive. In addition, the control system can adjust the vertical position of the mainshaft within the outer shell to change the size of the crushing gap.

In another contemplated embodiment, the gyratory crusher can include an outflow sensor that monitors the flow rate of crushed material from the gyratory crusher. Information from the outfeed sensor is fed to the control system such that the control system can modify the operation of the electric motor of the variable frequency drive to dynamically control the output feed from the gyratory crusher. The control system can modify the rotational speed of the eccentric such that the outflow feed from the gyratory crusher closely corresponds to the flow of material from a discharge hopper.

The present disclosure further relates to a method of controlling a rock crushing system that includes a gyratory crusher having a stationary outer shell that includes an interior crushing surface and a mainshaft that has a mantle including an exterior crushing surface. The interior crushing surface and exterior crushing surfaces create a crushing gap. Material is supplied to an dump hopper that is positioned above the gyratory crusher. The size and the amount of material within the dump hopper are determined, such as through the use of a camera.

Based upon the size and amount of material within the dump hopper, a variable frequency drive is operated to rotate an eccentric mounted to the mainshaft to create gyratory movement of the mantle within the outer shell. The rotational speed of the eccentric is dynamically controlled to control a flowrate of crushed material from the gyratory crusher. By controlling the flow rate of crushed material from the gyratory crusher, the size of a discharge hoper used to accumulate crushed material can be reduced.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
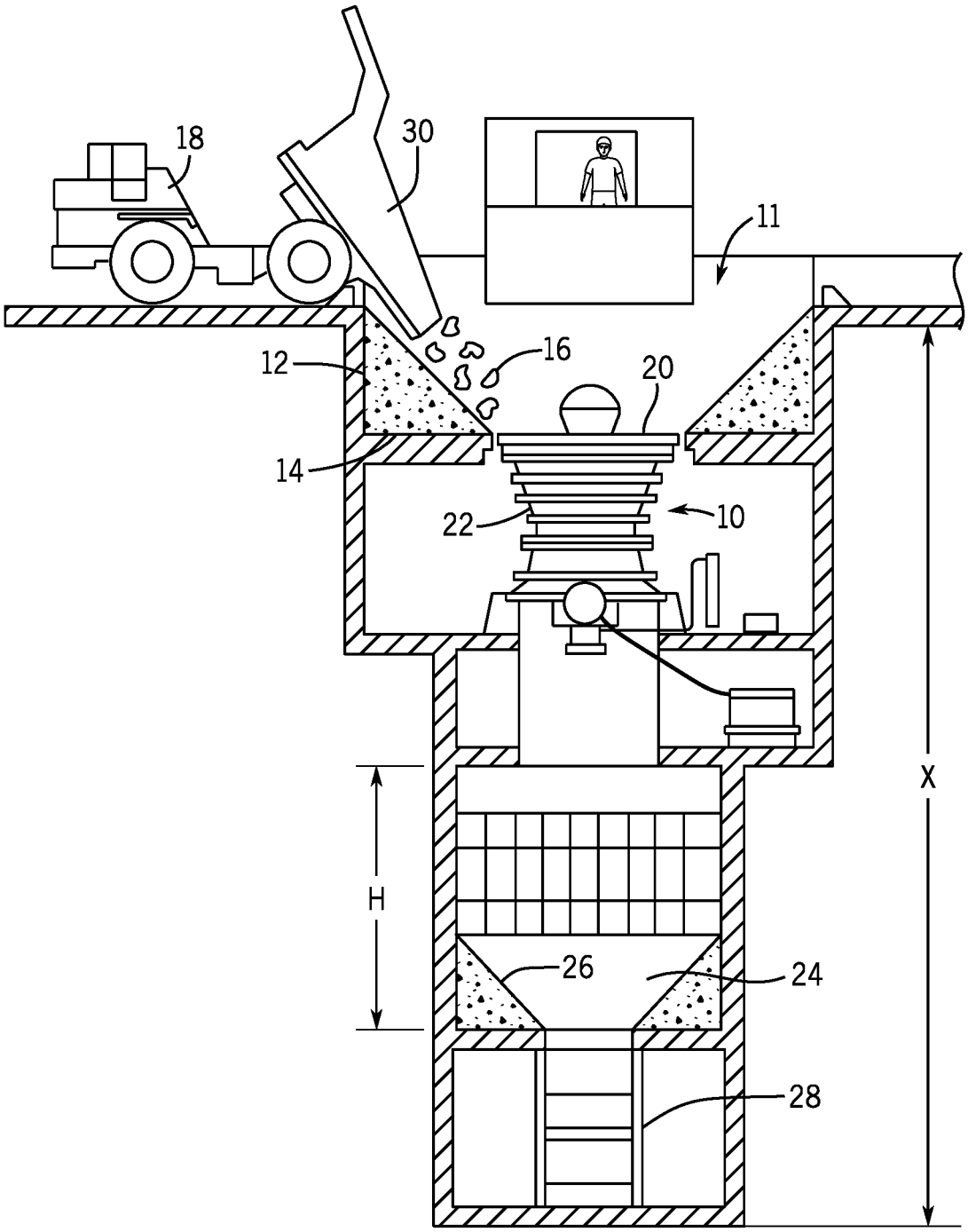
FIG. 1 is a schematic illustration of a gyratory rock crusher utilized as part of a rock crushing system.

FIG. 1 illustrates the general use of a rock crushing system 11 of the present disclosure. As illustrated in FIG. 1, a gyratory rock crusher 10 is positioned within a dump hopper 12 having a bottom wall 14. The dump hopper 12 receives a supply of material 16 to be crushed from various sources, such as a haul truck 18. The material 16 deposited into the dump hopper 12 is directed toward the open, upper feed end 20 of the gyratory crusher 10. During operation of the rock crushing system 11, the dump hopper 12 may accumulate a supply of material 16 which feeds through gravity into the upper feed end 20 of the gyratory crusher 10.

The material 16 enters the crushing cavity and passes through a concave assembly positioned along the stationary outer shell 22. Within the outer shell 22, a crushing mantle (not shown) gyrates and crushes the material within the crushing cavity. The crushed material created a flow of crushed material that exits the gyratory rock crusher 10 and enters into a discharge hopper 24. The discharge hopper 24 is shown in FIG. 1 as having a sloped inner wall 26 that directs the crushed supply of material onto a discharge conveyor assembly 28. The discharge conveyor assembly 28 operates to move the crushed material away from the rock crushing system 11 where the material can be further processed either through an additional crushing step or by being transported away from the mining site. Typically, the discharge conveyor assembly 28 operates at a constant rate and crushed material from the discharge hopper 24 is discharged onto the discharge conveyor assembly in a metered manner.

As can be understood in FIG. 1, the height H of the discharge hopper 24 dictates the amount of material that can be accumulated within the discharge hopper 24 before it is discharged onto the conveyor assembly 28. The height H of the discharge hopper 24 thus has a direct impact on the oversize height X of the rock crushing system 11. During construction of the rock crushing system 11, estimates for the cost to create the rock crushing system 11 are often specified by the overall height X of the rock crushing system 11. Thus, reducing the height H of the discharge hopper 24 will reduce the overall cost of the rock crushing system 11.

As described above, the volume, and thus the height H, of the discharge hopper 24 must be sufficient to accumulate material within the discharge hopper 24 before the material is removed by the conveyor assembly 28. In typical gyratory crusher feed systems, the amount of material 16 fed into the gyratory crusher 10 is controlled by the number of haul trucks 18 and the size of the truck bed 30. Typically, the truck bed 30 carries between 200 and 400 tons of rock. In some cases, a large supply of material may accumulate within the dump hopper 12 before the material can be crushed by the gyratory crusher 10. In other cases, only a very small supply of material may be within the dump hopper 12. In prior systems, the speed of the gyratory crusher 10 remains generally constant such that the flow rate of material from the gyratory crusher 10 and thus the volume of material within the discharge hopper 24 can vary drastically. In many embodiments, the size of the discharge hopper 24 is designed to be two to four times the capacity of the truck bed 30 in order to accumulate enough material so that the gyratory crusher 10 can operate at a constant speed while still feeding a constant flow of crushed material onto the discharge conveyor assembly 28.

Figure 2:
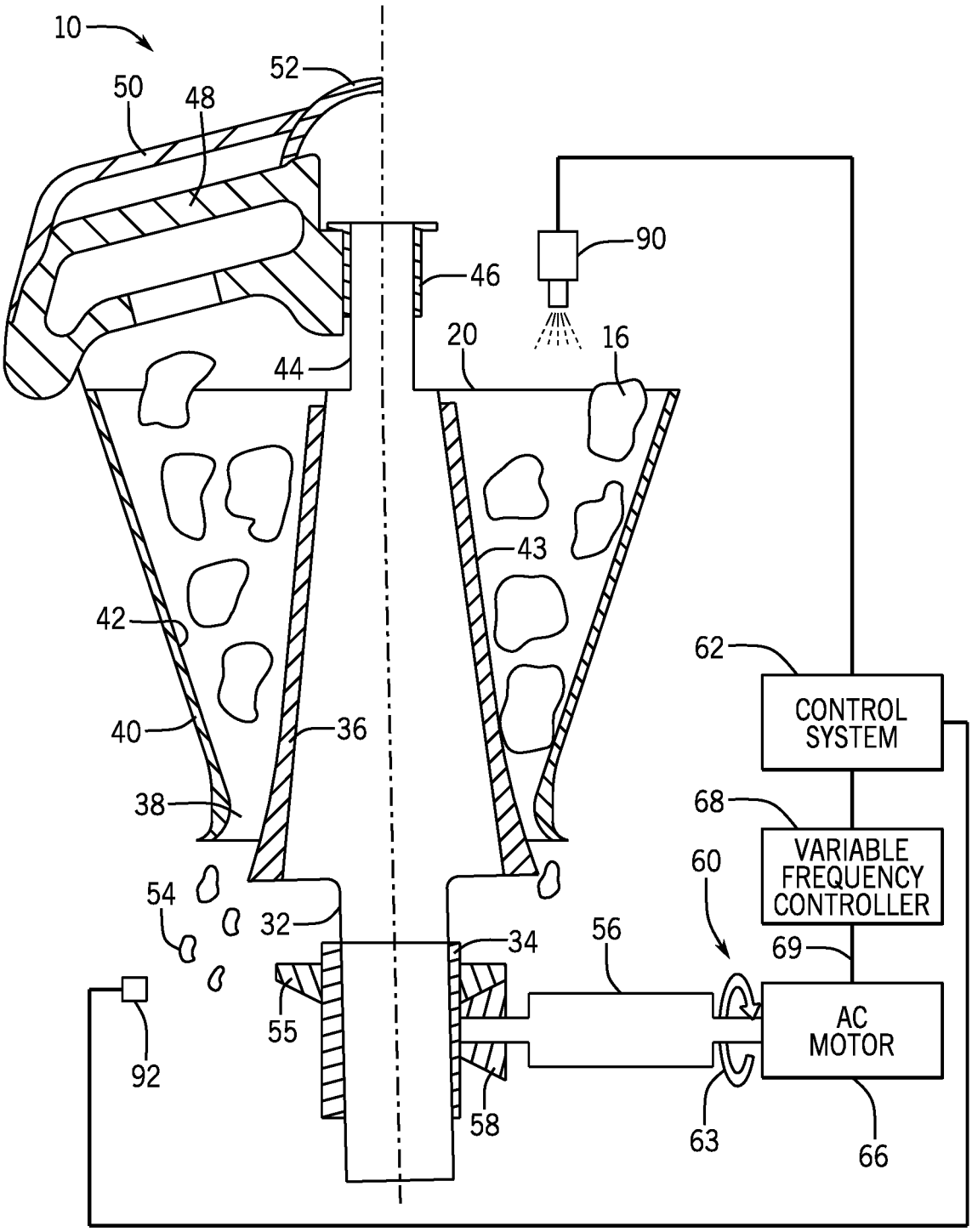
FIG. 2 is a partial section view of the gyratory crusher including a variable frequency drive of the present disclosure.

FIG. 2 illustrates one exemplary embodiment of the gyratory crusher 10 that can be utilized within the rock crushing system shown in FIG. 1. Although a representative gyratory crusher 10 is illustrated, it should be understood that various different embodiments of the gyratory crusher could be utilized while operating within the scope of the present disclosure. The gyratory crusher 10 shown in FIG. 2 includes a mainly vertical mainshaft 32 that includes an eccentric 34 mounted thereto. The mainshaft 32 includes a mantle 36 that creates a crushing gap 38 between the outer surface 43 of the mantle 36 and an inner surface 42 of an outer shell assembly 40. The inner surface 42 of the shell assembly 40 includes a single piece concave or rows of concaves that define the generally tapered frustoconical inner surface 42 that directs material from the open top end 20 downward through a converging crushing cavity to the crushing gap 38. Material is crushed over the height of the crushing cavity between the inner surface 42 of the outer shell and the outer surface 43 of the mantle.

The upper end 44 of the mainshaft 32 is supported by a bushing 46 contained within the center hub of a spider 48. In FIG. 2, one half of the spider 48 along with the shield 50 and top cap 52 are removed to facilitate understanding. Although the exemplary embodiment shown in FIG. 2 includes the spider 48, other embodiments of the gyratory crusher would not include a spider and the related supporting structure. Such embodiment would also fall within the scope of the present disclosure. As the material 16 moves through the crushing chamber, the size of the material is reduced such that a discharge flow of material 54 is created.

In the embodiment shown in FIG. 2, the rotation of the mainshaft 32 is controlled through a rotating pinion shaft 56 and pinion gear 58 that meshes with a gear 55 mounted to the eccentric 34 in a conventional manner. The pinion 56 is directly or indirectly coupled to a variable speed drive (VFD) 60 in accordance with the present disclosure. The variable frequency drive 60 operates to rotate the pinion 56 as illustrated by the rotational arrow 63 shown in FIG. 2. The variable frequency drive 60 is coupled to a control system 64.

In accordance with the present disclosure, the variable-frequency drive (VFD) is a type of adjustable speed electromechanical drive system that controls the operating speed of an electric motor 66 by varying the motor input frequency and voltage. In the embodiment shown in FIG. 2, the variable frequency drive 60 includes the AC motor 66 and a variable frequency controller 68. The variable frequency controller 68 has a power electronics conversion system that submits an output signal to the AC motor 66 along control line 69 to control the operation of the AC motor 66. Through the control of the frequency of the output signal from the variable frequency controller 68, the variable frequency controller 68 can control the operational speed of the AC motor 66. In the embodiment shown in FIG. 2, a control system 62 for the gyratory crusher 10 is in further communication with the variable frequency controller 68 such that the operational controls for the gyratory crusher are able to control the speed of the AC motor 66 through the variable frequency controller 68.

Figure 3:
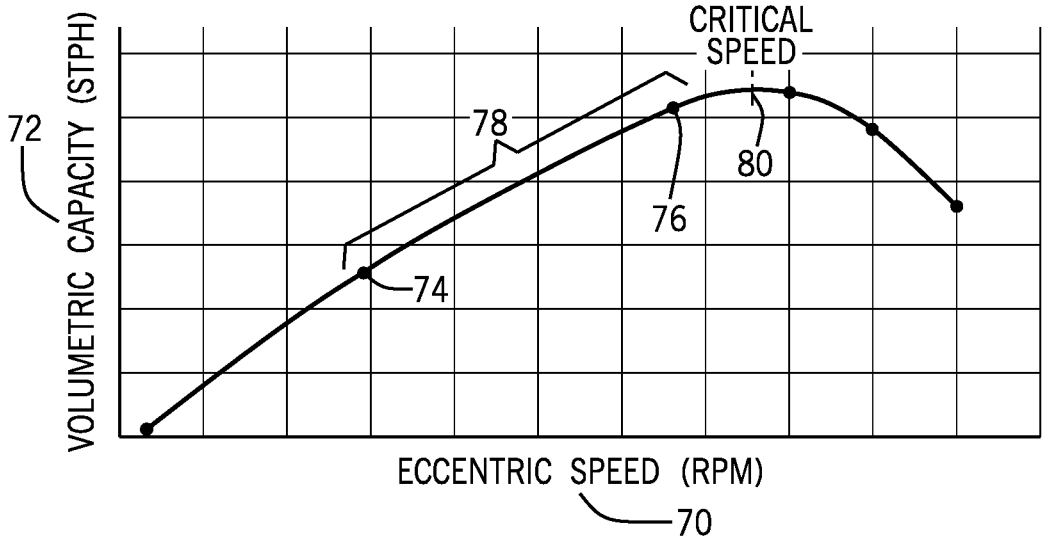
FIG. 3 is a graph illustrating the relationship between eccentric speed and volumetric output of a gyratory crusher.

As can be understood by the description in FIG. 2, the variable frequency drive 60 allows the operational speed of the eccentric 34 to be adjusted by modifying the frequency of the control signal from the variable frequency controller 68. FIG. 3 provides a graphic illustration relating the eccentric speed 70 to the volume output 72 from the crusher. It should be understood that the values shown in FIG. 3 are representative values for one type of crusher and are not meant to be limiting and are for illustrative purposes only. In the chart shown in FIG. 3, the operational speed of prior art gyratory crushers that utilized a conventional diesel powered drive motor is shown by point 74. Point 74 illustrates that at an eccentric speed of approximately 150 RPM, the volume output of the gyratory crusher is approximately 3,500 tons per hour. In accordance with the present disclosure and through the use of the variable frequency drive 60 shown in FIG. 2, the eccentric speed can be adjusted between the point 74 and an upper point 76. The two points 74 and 76 create a sub-critical zone 78 where the variable frequency drive 60 will operate the AC motor 66 to create the desired eccentric speed 70.

The graph of FIG. 3 further illustrates a critical speed 80. When the eccentric is operated at a speed greater than the critical speed 80, the volumetric output of the gyratory crusher begins to decrease. Thus, it is desired to operate the gyratory crusher at a speed within the sub-critical zone 78 to optimize the operation of the crusher.

Figure 4:
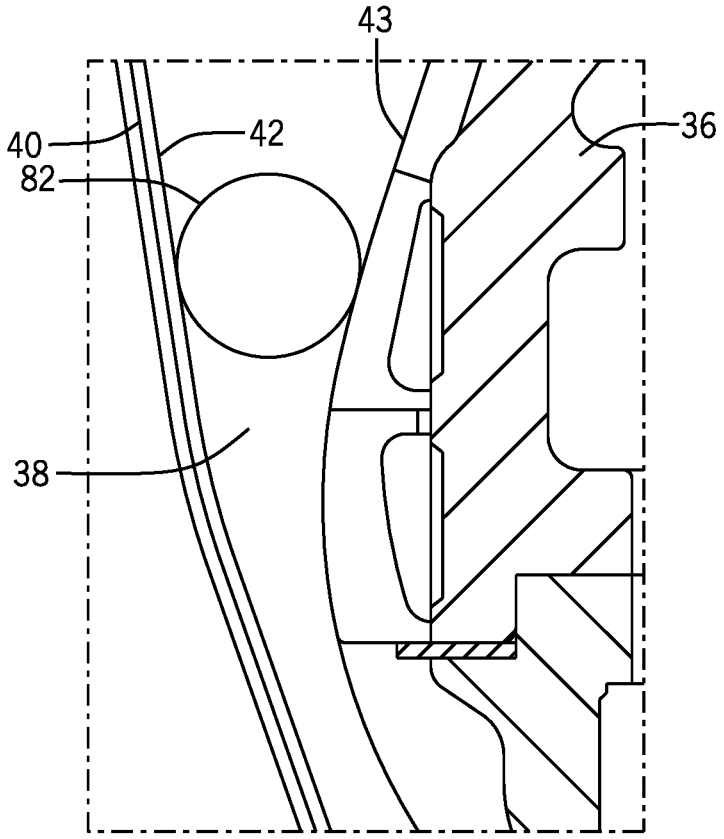
FIG. 4 is an illustration of the movement of material through the crushing gap of the gyratory crusher.

FIG. 4 is a graphical illustration to describe the sub-critical speed and critical speed shown in FIG. 3. In the illustration of FIG. 4, a round ball 82 is shown located within the crushing gap 38 defined by the inner surface 42 of the shell 40 and the outer surface 43 of the mantle 36. As an illustrative example, if the crusher were at rest, the round ball 82 would become wedged between the crushing surfaces on the closed side of the crushing gap. As the eccentric begins to rotate the crushing head, the ball 82 will begin to slide down the chamber as the gap at that point in the chamber begins to widen from the closed side to the open side position. The ball will begin to slide down the head but does not free fall because the size of the ball is larger than the gap. Once the head is at the open side, the gap begins to compress the ball and the ball deflates until the diameter of the ball is equal to the closed side crushing gap. This will be repeated until the ball exits the crusher.

As the rotational speed of the eccentric increases, the ball 82 will be able to freefall within the expanding gap until the rotational speed matches the freefall speed of the ball. This point is referred to as the critical speed. If the rotations frequency is further increased, the head returns faster than the ball drops and the crusher will be operating at a super-critical speed. As indicated above, the critical speed 80 is the fastest speed desired for the rotation of the eccentric.

Referring back to FIG. 2, the control system 62 is further designed to include a camera 90 that is positioned to detect the size of the material 16 being fed into the open feed end 20 of the gyratory crusher 10. The camera 90 can be a video camera or a still camera or any other type of device that creates a visual image of the material. The camera 90 provides visual images to the control system 62 such that the control system 62 can detect the typical particle size distribution of the material 16 being fed into the gyratory crusher 10. Another sensor (not shown) can be positioned within the dump hopper provide an indication of the level of material in the dump hopper. Based upon the size of the particles being fed into the open end 20 of the gyratory crusher, the control system 62 can automatically adjust the size of the crushing gap 38 by moving the vertical position of the mainshaft 32. In currently available gyratory crushers, the size of the crushing gap 38 can be adjusted utilizing a hydraulic assembly to adjust the vertical position of the mainshaft 32. A similar arrangement would be utilized within the gyratory crusher of FIG. 2. However, in accordance with the system of FIG. 2, the control system 62 can automatically adjust the vertical position of the mainshaft based upon the size of the material 16, as sensed by the camera 90.

In addition to measuring the product size, the camera 90 can also be used to detect the flow of material into the open feed end 20 of the gyratory crusher 10. The flow of material into the dump hopper will cause material to accumulate above the gyratory crusher 10 until the gyratory crusher can act on the material to crush the material.

In the embodiment shown in FIG. 2, a flow rate sensor 92 can be positioned near the discharge outlet of the gyratory crusher 10. The flow rate sensor 92 can detect the flow of material out of the gyratory crusher 10 and into the discharge hopper. Based on this detected output flow rate as well as the level of material in the discharge hopper, the control system 62 can dynamically adjust the speed of the electric motor 66 to optimize the flow rate from the gyratory crusher 10. As indicated above, the relationship between the output flow rate and the rotation speed of the eccentric is shown by the graph of FIG. 3. It is desirable to operate the gyratory crusher in the sub-critical zone 78.

As can be understood above, the use of the variable frequency drive 60 with the gyratory crusher 10 allows the control system 62 to dynamically optimize the operation of the gyratory crusher. The control system 62 can measure the feed to the crusher along with other crusher operating parameters, including hydraulic pressure, temperature and available power from the AC motor 66 such that the control system 62 can adjust the crusher eccentric speed to reach the highest capacity and/or lowest wear rates on the crusher linings.

As an illustrative example, the control system 62 can cause the AC motor 66 to operate at a faster speed to increase production when the feed into the gyratory crusher is suitable. Alternatively, if the feed rate into the gyratory crusher is small, the speed of the AC motor 66 is reduced to reduce wear rates on the wear components within the gyratory crusher. It is desirable to maintain operation of the gyratory crusher with material such that the gyratory crusher operates as infrequently as possible with no material present. By optimizing the operational speed of the eccentric within the crusher, less material needs to be accumulated in the discharge hopper, which allows the size of the discharge hopper to be reduced.

In one exemplary embodiment, the control system 62 can operate the variable frequency drive in an attempt to closely match the output flow rate from the gyratory crusher 10 to the flow rate of material on the conveyor assembly. In this manner, the amount of material accumulated within the discharge hopper can be minimized, which will allow the volume, and thus the height H, of the discharge hopper to be reduced. Although it is desirable to have some amount of material within the discharge hopper at all times, reducing the amount of material within the discharge hopper will allow the size of the discharge hopper to be reduced.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A gyratory crusher operable to reduce the size of material fed into an open feed end of the crusher from a dump hopper, comprising:

a stationary outer shell having an interior crushing surface;

a mainshaft having a mantle including an exterior crushing surface that creates a crushing gap with the interior crushing surface of the outer shell;

an eccentric positioned to surround a portion of the mainshaft;

a variable frequency drive coupled to the eccentric to create rotation of the eccentric and the mainshaft;

a level sensor positioned to detect a level of material within the open feed end of the crusher;

a camera positioned above the open feed end of the crusher and operable to detect the size of the material fed from the dump hopper into the open feed end of the crusher; and a control system for controlling the rotational speed of the eccentric through control of the variable frequency drive, wherein the control system is in communication with the level sensor and the camera and is operable to control the rotational speed of the eccentric based on the detected size of the material.

2. The gyratory crusher of claim 1 wherein the variable frequency drive includes an electric motor and a variable frequency controller operable to generate a control signal to the electric motor to control the speed of the electric motor.

3. The gyratory crusher of claim 1 wherein the control system is operable to adjust the position of the mainshaft relative to the stationary outer shell to modify the crushing gap.

4. The gyratory crusher of claim 1 wherein the control system operates the variable frequency drive to rotate the eccentric at a speed below a critical speed for the gyratory crusher.

5. The gyratory crusher of claim 1 wherein the control system controls the rotational speed of the eccentric to control a flow rate of material out of the gyratory crusher.

6. The gyratory crusher of claim 5 further comprising a discharge hopper positioned to receive the discharge of crushed material from the gyratory crusher.

7. The gyratory crusher of claim 6 wherein the control system controls the flow rate of material out of the gyratory crusher to maintain a desired level of crushed material within the discharge hopper.

* * * * *